US006389141B1

(12) United States Patent
Kang

(10) Patent No.: US 6,389,141 B1
(45) Date of Patent: May 14, 2002

(54) COMBINATION OF A SPEAKER CASE AND A CONNECTOR FOR CONNECTING TWO SPEAKER CASES

(76) Inventor: Shih Chang Kang, No. 125-1, San Min Road Section 1, Taichung (TW)

( * ) Notice: Subject to any disclaimer, the term of this patent is extended or adjusted under 35 U.S.C. 154(b) by 0 days.

(21) Appl. No.: 09/376,400

(22) Filed: Aug. 18, 1999

(51) Int. Cl.[7] ..... H04R 25/00

(52) U.S. Cl. ..... 381/182; 381/386; 381/395; 381/87

(58) Field of Search ..... 381/300, 301, 381/304, 305, 87, 89, 332, 333, 335, 182, 186, 386, 388, 395; 248/146, 150, 558, 311.2, 313, 316.1; 181/199

(56) References Cited

U.S. PATENT DOCUMENTS 4,031,318 A * 6/1977 Pitre ..... 381/386

5,714,723 A * 2/1998 Kang ..... 181/199

FOREIGN PATENT DOCUMENTS

JP 000351863 * 1/1990 ..... 381/FOR 146

* cited by examiner

*Primary Examiner*—Sinh Tran
(74) *Attorney, Agent, or Firm*—Charles E. Baxley

(57) ABSTRACT

A speaker case includes a first part and a second part connected to the first part. Each of the first part and the second part has a recess defined in each sidewall thereof and the two recesses are cooperated to define a hole through the case. A connector includes a tubular body with grooves defined in the outer periphery thereof so that the sidewalls of the first part and the second part a first case are engaged with one groove, and the sidewalls of a second case are engaged with the other groove so that the two speaker cases are combined together. The connector may have a close end, an enlarged end or a threaded inside so as to have further functions.

9 Claims, 13 Drawing Sheets

COMBINATION OF A SPEAKER CASE AND A CONNECTOR FOR CONNECTING TWO SPEAKER CASES

FIELD OF THE INVENTION

The present invention relates to a speaker case structure and a connector for connecting two speaker cases. Each speaker case is composed of tow parts with holes defined in at least one sides thereof so as to engage with a connector.

BACKGROUND OF THE INVENTION

A conventional speaker has a fixed shape which cannot be changed by the users. Furthermore, some speakers are supported and connected to a frame and some speakers are not connected to a frame, the users cannot connect the speakers together if the users want to obtain a better surrounding audio feature, because it is impossible for the users to disassemble the cases of the speakers and connect the speakers as a huge one.

The present invention intends to provide a combination of a speaker case and a connector which is connected between two speaker cases so that the users may combine variety of speaker cases together and the speaker cases communicate with each other. According to the present invention, the inherent disadvantages of the conventional speaker cases can be mitigated.

SUMMARY OF THE INVENTION

In accordance with one aspect of the present invention, a combination of a speaker case and a connector is provided. The speaker case comprises a first part and a second part which is connected to the first part. The first part has a surface board with four sidewalls and each sidewall of the first part has a first recess defined in an edge thereof. The second part has a surface board with four sidewalls and each sidewall of the second part has a second recess defined in an edge thereof. The first recess and the second recess are cooperated to define a hole through the case. The connector has a tubular body and two annular grooves are defined in a periphery of the tubular body. The connector is engaged with the hole in the speaker case and the sidewall of the first part and the sidewall of the second part are engaged with one of the annular grooves of the connector.

The main object of the present invention is to provide a combination of a speaker case and a connector so that multiple of speaker cases can be connected together as desired.

Further objects, advantages, and features of the present invention will become apparent from the following detailed description with appropriate reference to the accompanying drawings.

DETAILED DESCRIPTION OF THE PREFERRED EMBODIMENTS

Figure 1:
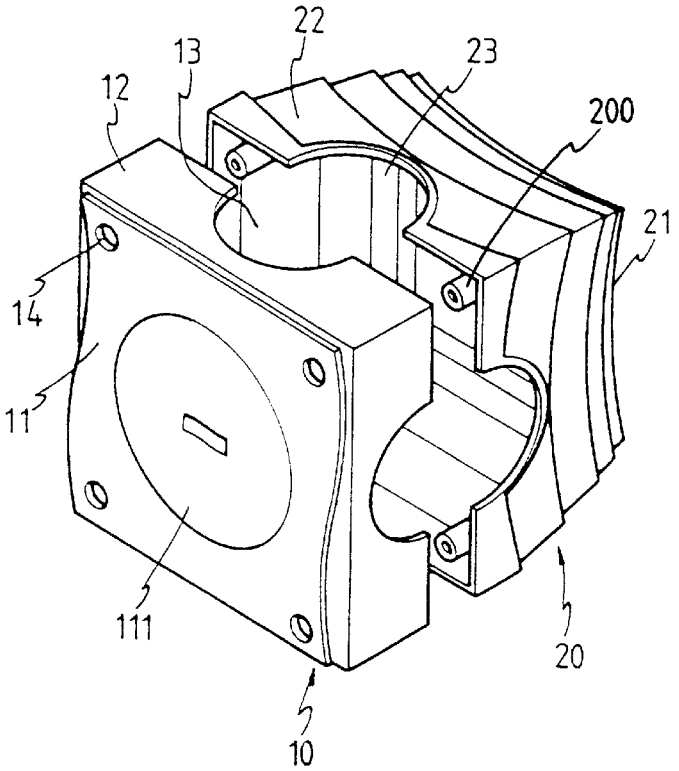
FIG. 1 is an exploded view of the first part and the second part of a speaker case in accordance with the present invention.
Figure 2:
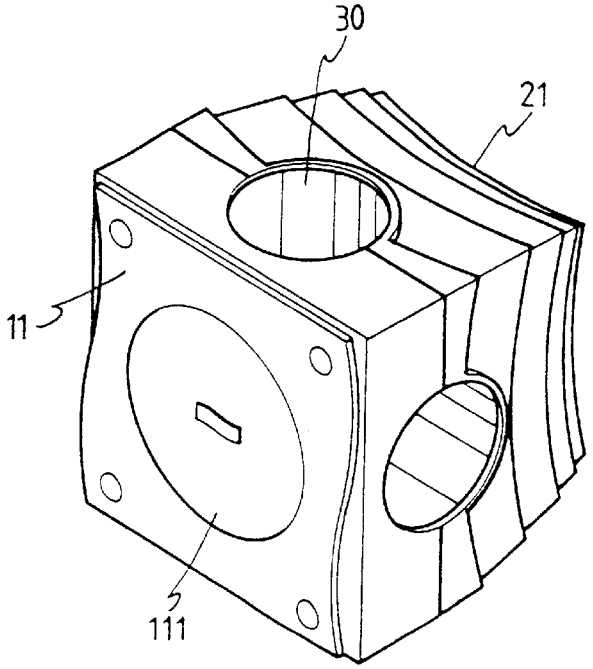
FIG. 2 is a perspective view of the speaker case in accordance with the present invention.
Figure 3:
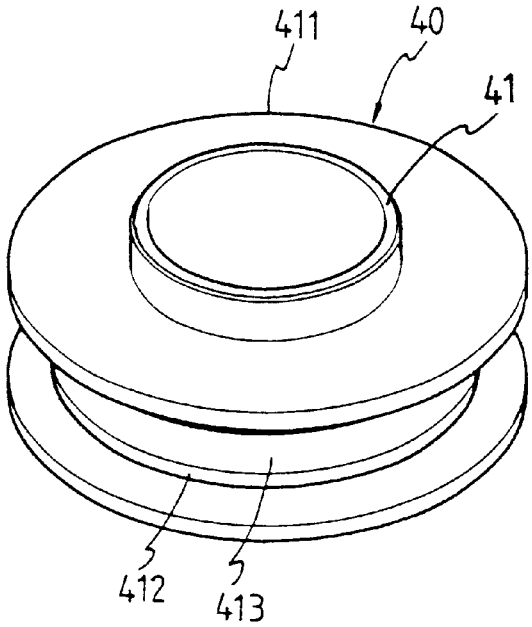
FIG. 3 is a perspective view of a first embodiment of the connector in accordance with the present invention.
Figure 4:
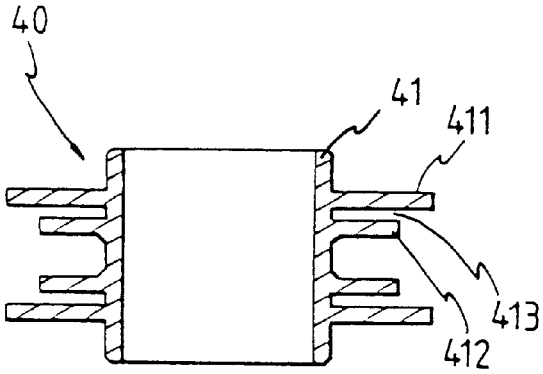
FIG. 4 is a side elevational view, partly in section, of the connector in accordance with the present invention.

Referring to FIGS. 1 to 5, the speaker case comprising a first part 10 and a second part 20 which is connected to the first part 10 by four bolts extending through four comer apertures 14 in the first part 10 and engaged with the four tubes 200 extending from the second part 20. The first part 10 has a surface board 11 with four sidewalls 12 extending from the surface board 11 of the first part 10. Each of the sidewalls 12 of the first part 10 each have a first recess 13 defined in an edge thereof and the surface plate 11 has an engaging hole for the drum 111 engaged therewith. The second part 20 has a surface board 21 with four sidewalls 22 extending from the surface board 21 of the second part 20. Each of the sidewalls 22 of the second part 20 each have a second recess 23 defined in an edge thereof. When the first part 10 and the second part 20 are connected together, the four first recesses 13 are located to cooperate with the four second recesses 23 to define four holes 30 through the fout sides of the speaker case.

Figure 5:
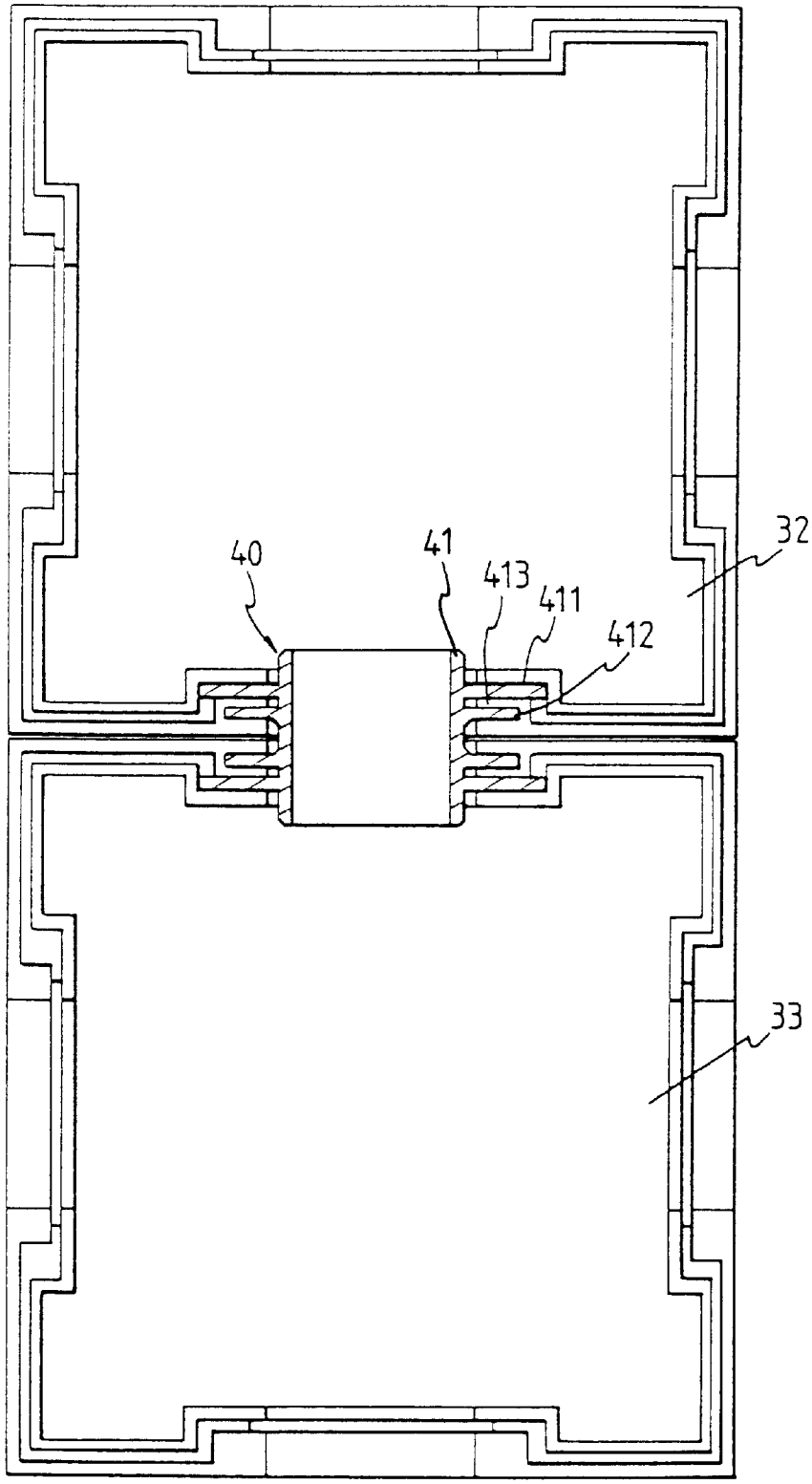
FIG. 5 is a side elevational view, partly in section, of two speaker cases are combined by the connector in accordance with the present invention.

The connector 40 includes a tubular body 41 and two pairs of flanges 411, 412 extending from the periphery of the tubular body 41 so that two annular grooves 413 are defined between the two pairs of flanges 411, 412 of the tubular body 40./As shown in FIG. 5, when connecting two speaker cases 32, 33, The connector 40 is engaged with the two respective holes 30 in the two speaker cases 32, 33. The sidewall 12 of the first part 10 and the sidewall 22 of the second part 20 of the first speaker case 32 are engaged with one of the annular grooves 413 of the connector 40, and the sidewalls 12, 22 of the other speaker case 33 is engaged with the other annular grooves 413 of the connector 40. In this way, the two speaker cases 32, 33 are connected together. The two speaker case 32, 33 communicate with each other.

Figure 6:
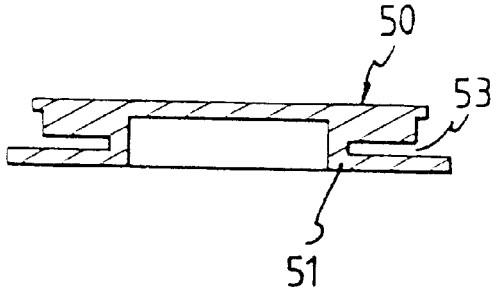
FIG. 6 is a cross-sectional view to show a second embodiment of the connector in accordance with the present invention.
Figure 7:
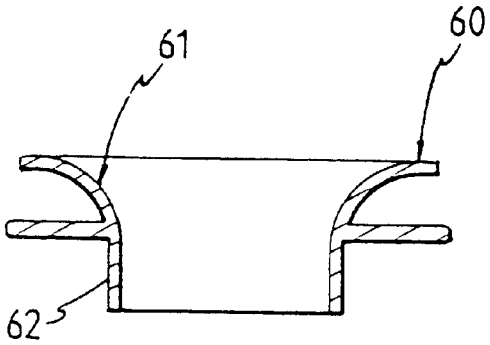
FIG. 7 is a cross-sectional view to show a third embodiment of the connector in accordance with the present invention.
Figure 8:
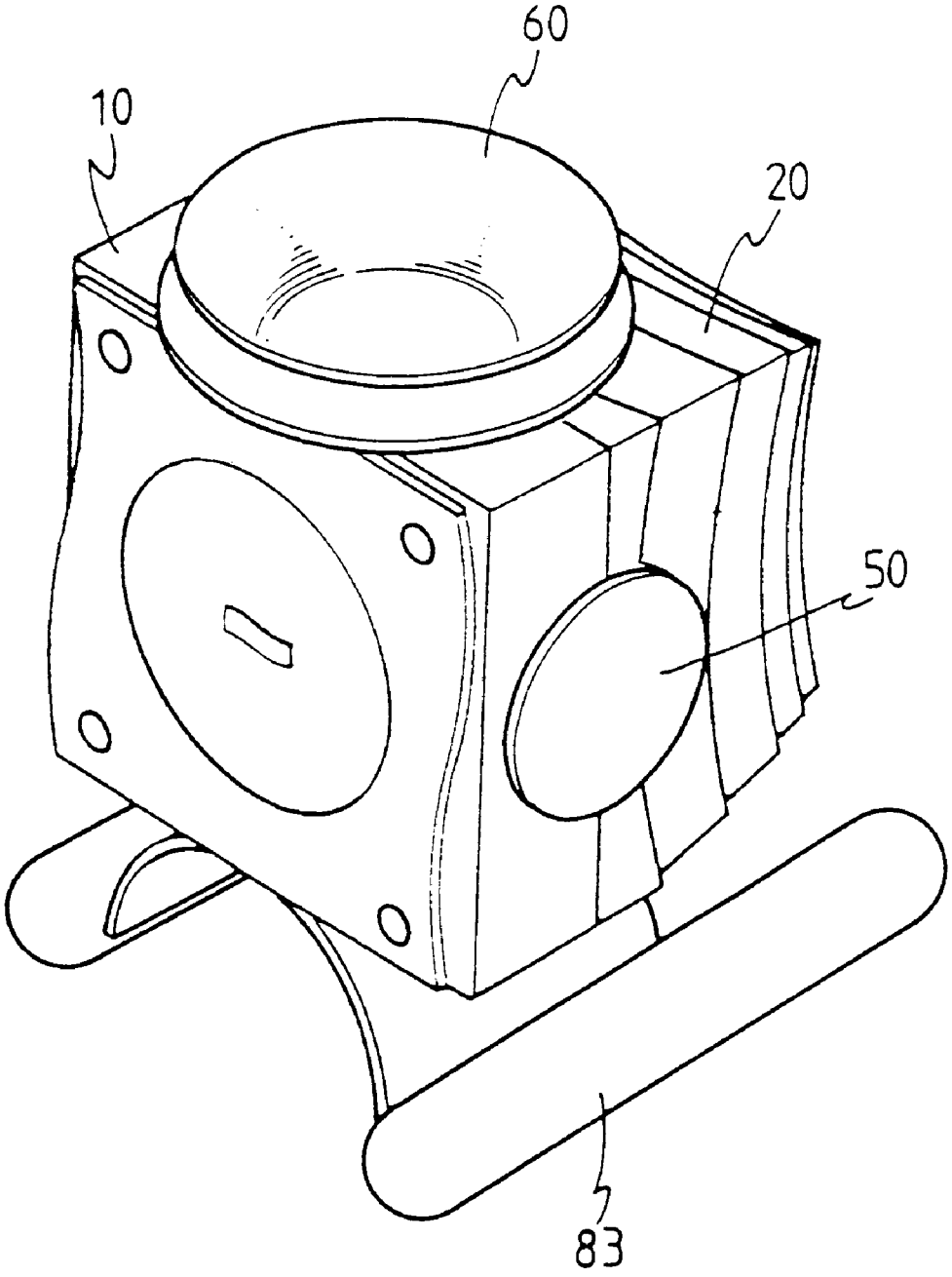
FIG. 8 is a perspective view to show a speaker case is connected to a connector as shown in FIG. 7 and supported by a frame.

FIG. 6 show a second embodiment of the connector 50 which has an annular groove 53 defined in the periphery thereof and the tubular body 51 of the connector 40 has a close end. The second embodiment of the connector 50 is used to seal a hole of the speaker case as shown in FIG. 8. FIG. 6 show a third embodiment of the connector 60 whose tubular body 62 has an enlarged end 61. The connector 60 is used to let sound transmit form the enlarged end 61 thereof as shown in FIG. 8. A frame 83 is used to support the speaker case.

Figure 9:
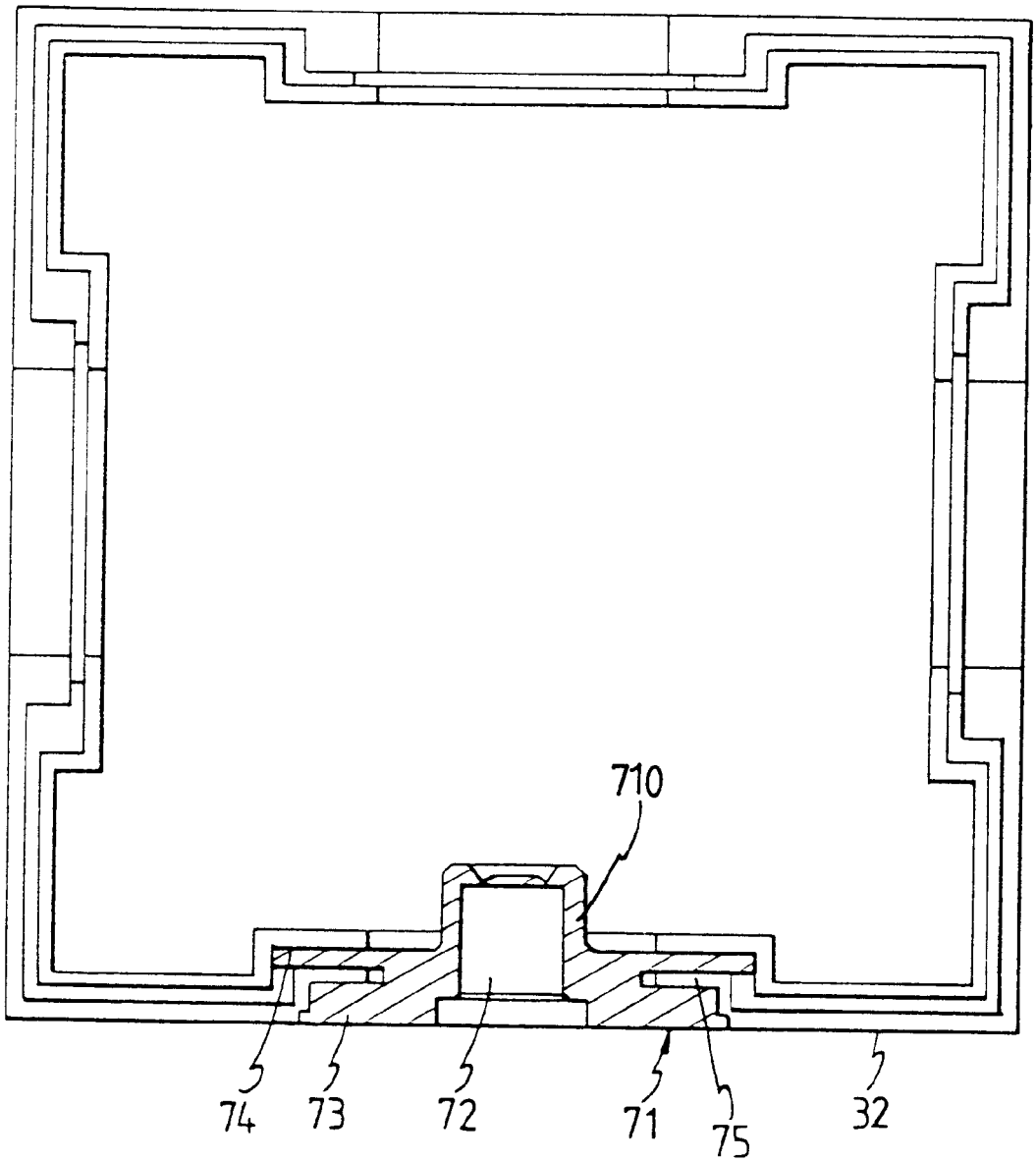
FIG. 9 is a cross-sectional view to show a fourth embodiment of the connector engaged with a speaker case.
Figure 10:
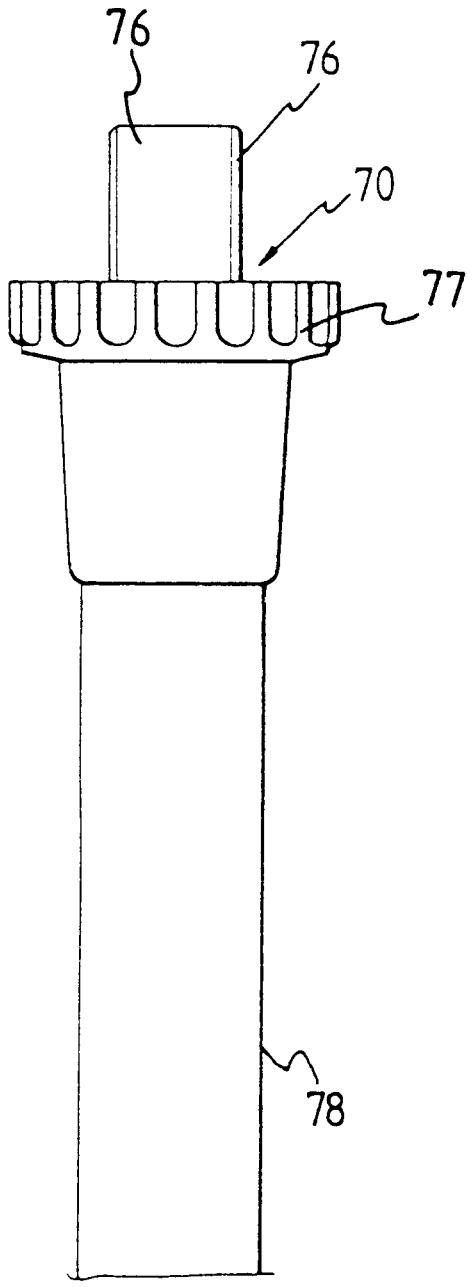
FIG. 10 is an illustrative view to show a post to be connected to the fourth embodiment of the connector as shown in FIG. 9.
Figure 11:
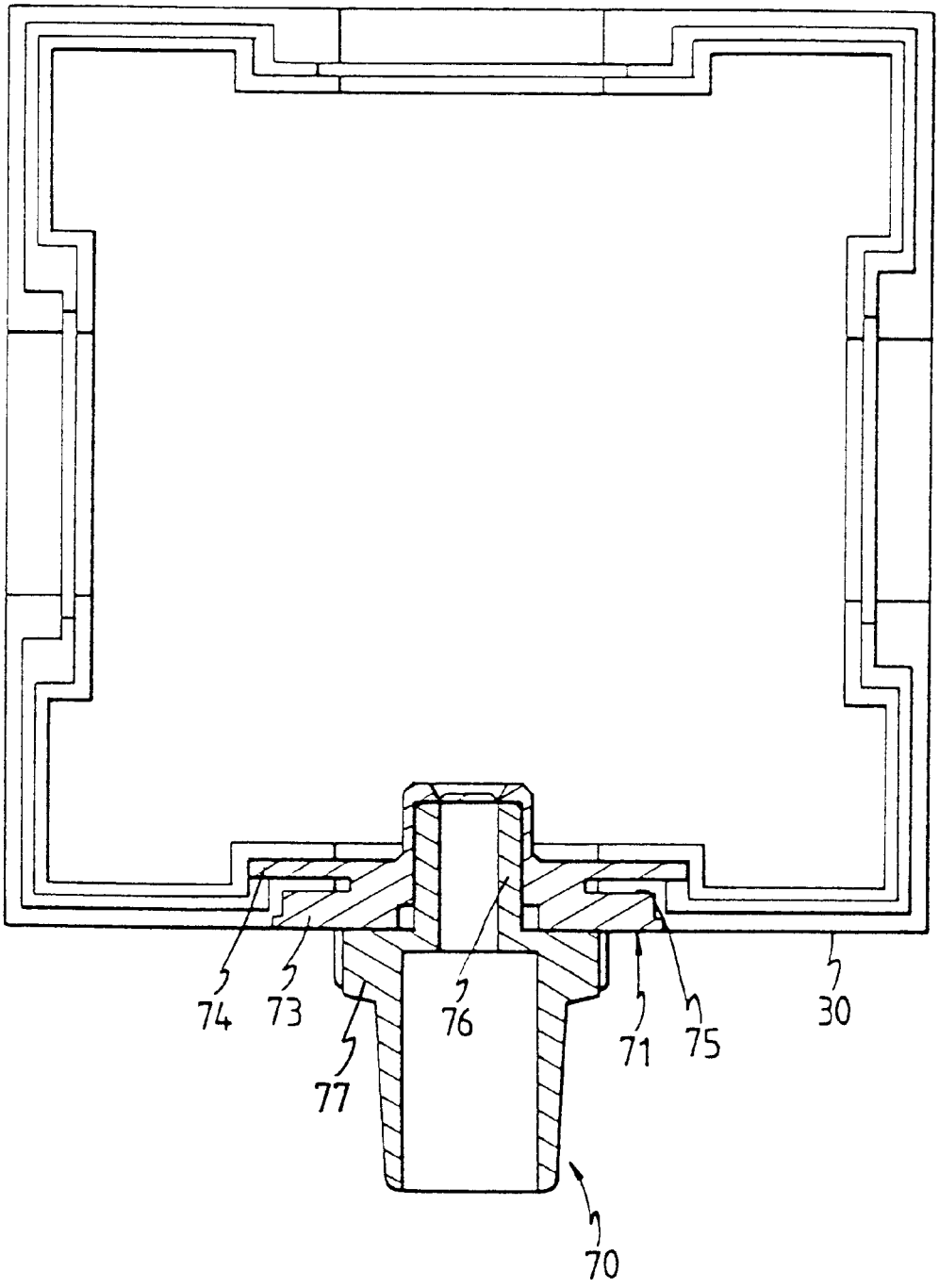
FIG. 11 is a cross-sectional view to show the post is engaged with the fourth embodiment of the connector.
Figure 12:
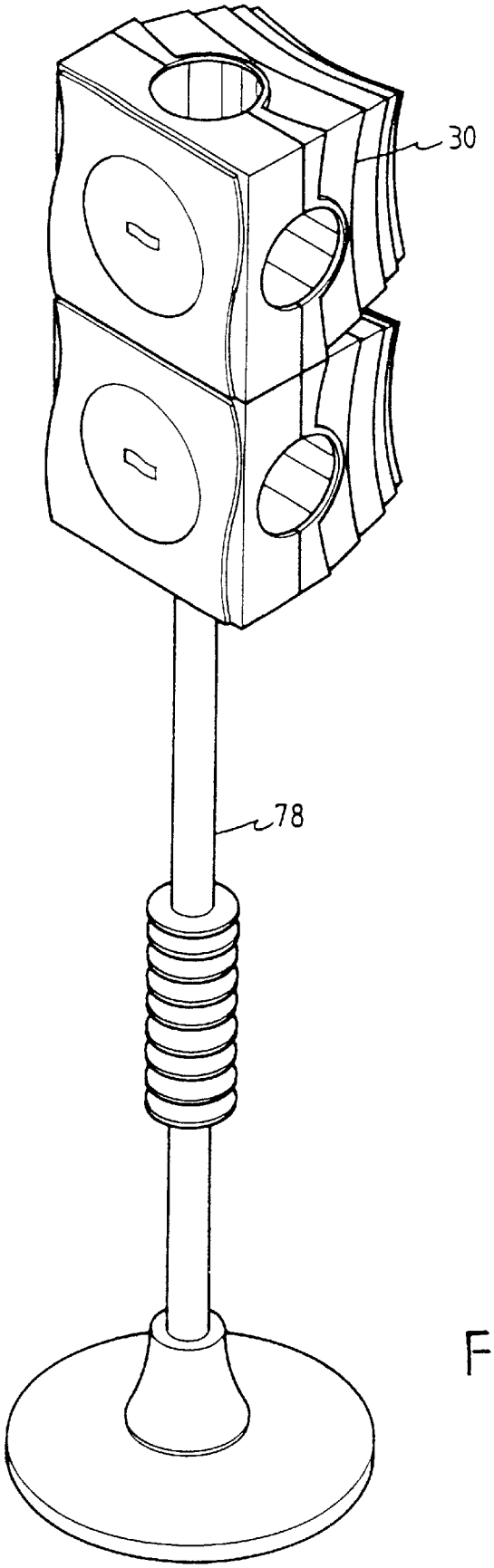
FIG. 12 is an illustrative view to show two speaker cases are supported by the post shown in FIG. 10.

FIG. 9 shows a fourth embodiment of the connector 71 wherein the tubular body 710 of the connector 40 has a threaded inside 72. Two flanges 73, 74 extend from the periphery of the tubular body 710 and an annular groove 75 is defined between the two flanges 73, 74 so as to engage with a speaker case 32. FIG. 10 shows a post 78 having a head 70 which includes a flange 77 and a rod portion 76 with an outer threaded periphery 760. As shown in FIG. 11, the rod portion 76 is engaged with the threaded inside 72 of the tubular body 710 of the connector 71, and the flange 77 contacts against the outside of the speaker case 32. Therefore, as shown in FIG. 12, two speaker cases 30 can be supported on the post 78.

Figure 13:
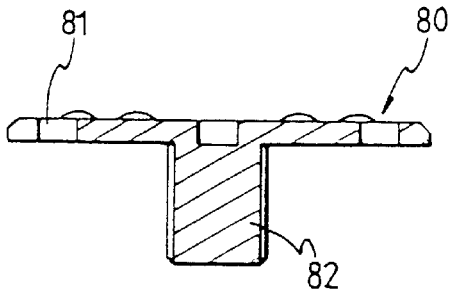
FIG. 13 is a cross-sectional view to show an engaging member of the present invention.
Figure 14:
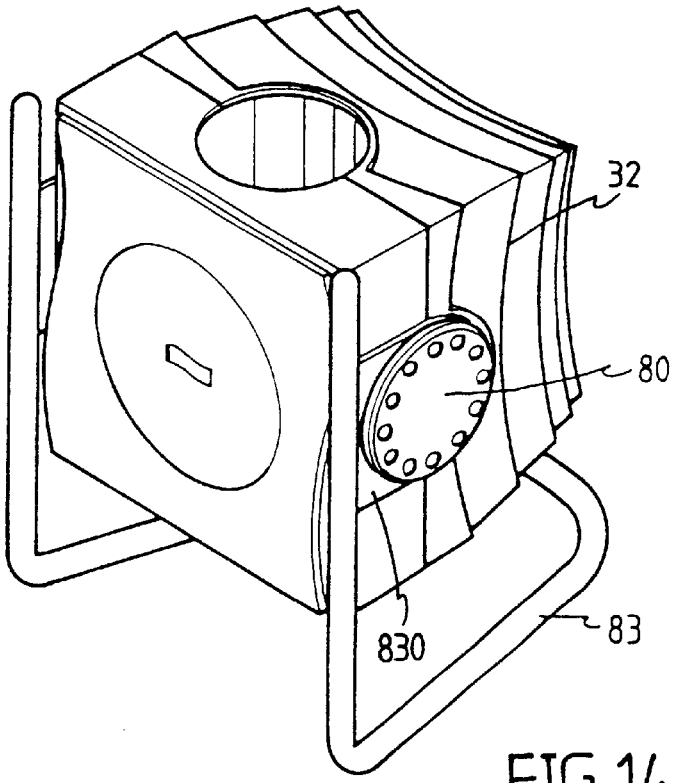
FIG. 14 is a perspective view to show a speaker case with the engaging member and a frame is connected to the engaging member.
Figure 15:
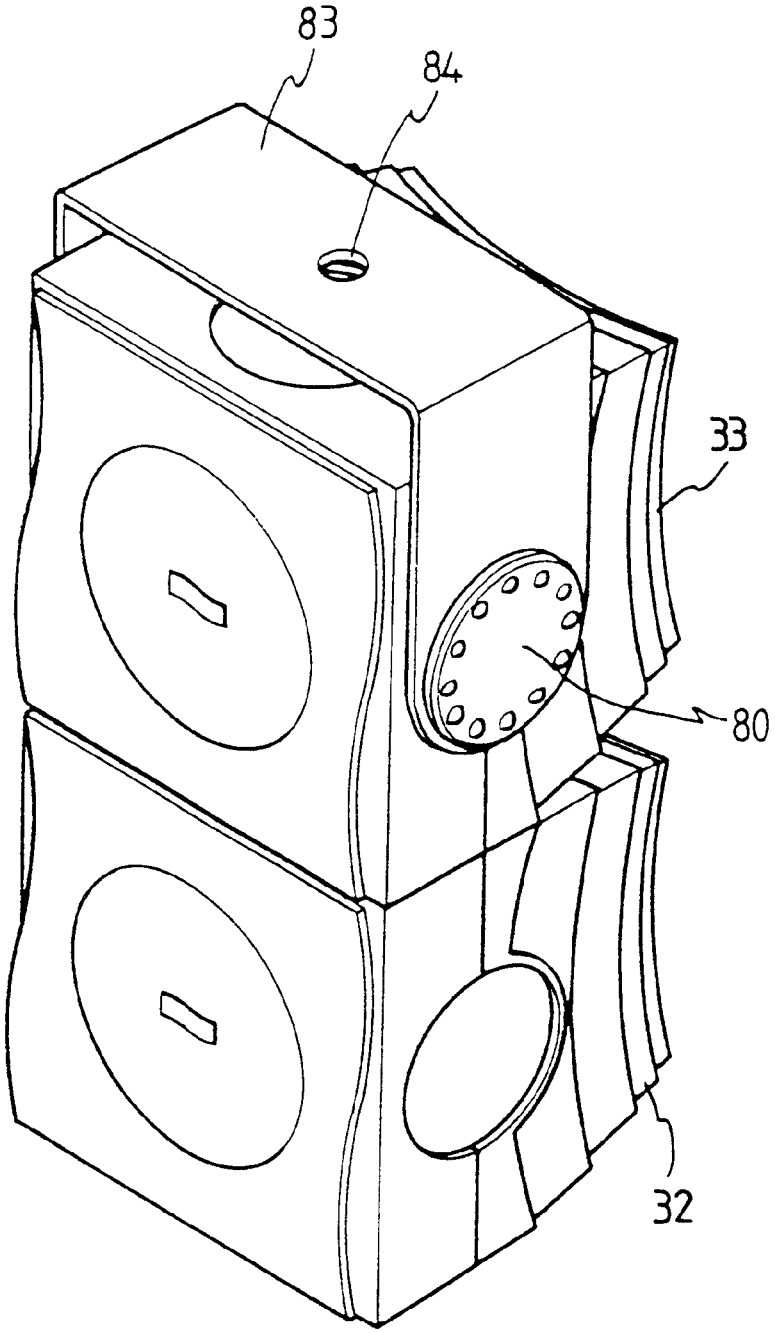
FIG. 15 is a perspective view to show two speaker cases connected together and one of the cases having the engaging member is connected to a frame.

FIG. 13 shows an engaging member 80 to be used with the speaker case, wherein the engaging member 80 has a threaded shank 82 for being engaged with the threaded inside 72 of the tubular body 710 of the connector 71. A disk 81 is connected to the threaded shank 82. The frame 83 has two lugs 830 and each of the lugs 830 has a hole (not shown) so as to let the threaded shank 82 pass through. The two lugs 830 are fixedly clamped by the disk 81 and the speaker case 32. Referring to FIG. 15, another U-shaped frame 83 is connected between the two engaging members 80 and the frame 80 can be pivoted by adjusting the two disks 80. The frame 83 further has a hole 84 so that the two speaker cases 32, 33 can be hung on a wall.

Figure 16:
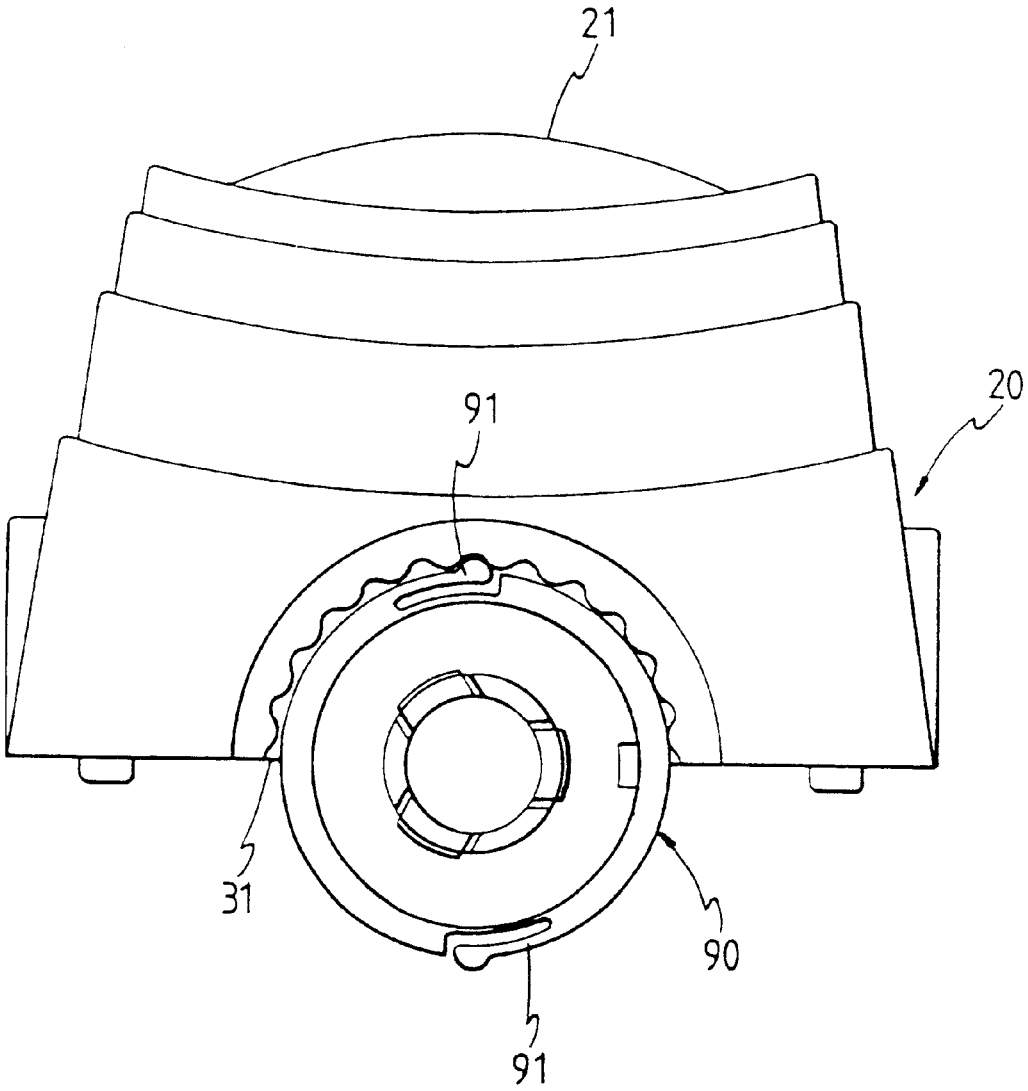
FIG. 16 is an illustrative view to illustrate a fifth embodiment of the connector and the speaker case.
Figure 17:
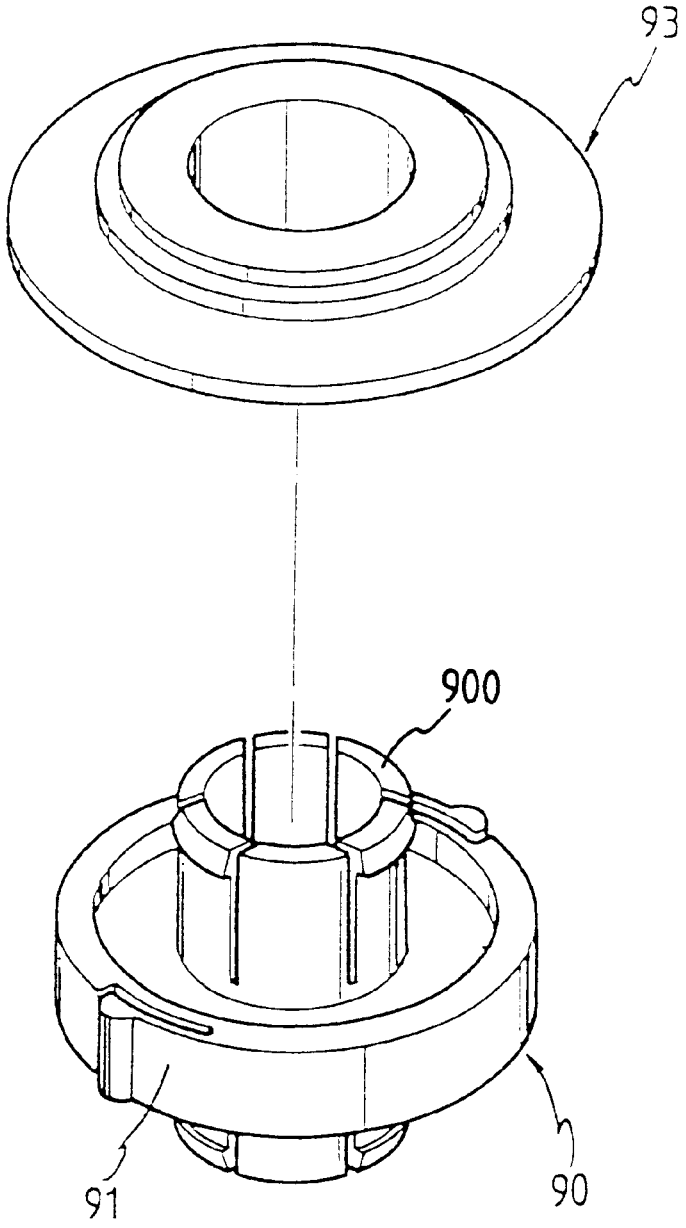
FIG. 17 is an exploded view of the fifth embodiment of the connector as used in FIG. 16.

FIGS. 16 and 17 show a fifth embodiment of the connector 90 wherein the tubular body 900 of the connector 90 has a flange with two flexible bosses 91 on the periphery of the flange. A disk member 93 having a central hole is engaged between two speaker cases and the tubular body 900 is engaged with the central hole of the disk member 93. The second recess of the second part 21 of the speaker case has a serrated periphery 31 so that the flexible bosses 91 can be positioned by engaging with the serrated periphery 31. Accordingly, the speaker case can be pivoted and positioned about the connector 90 by engaging the flexible bosses 91 with the serrated periphery 31.

The invention is not limited to the above embodiment but various modification thereof may be made. It will be understood by those skilled in the art that various changes in form and detail may made without departing from the scope and spirit of the present invention.

What is claim is:

1. A speaker case comprising:

four symmetrical side walls each having a recess defined therein, each of said four side walls aligning with a respective opposite side wall, and said recess of each of said four side walls aligning with a recess of said respective opposite side wall, to form a hole and a connector including a tubular body adapted to be fitted into said hole of one of said four side walls of said speaker case and having two annular grooves each defined in a periphery of said tubular body, and said side wall of said speaker case engaged with one of said two annular grooves of said connector.

2. The speaker case as claimed in claim 1, wherein said tubular body of said connector has a close end.

3. The speaker case as claimed in claim 1, wherein said tubular body of said connector has an enlarged end.

4. The speaker case as claimed in claim 1, wherein said tubular body of said connector has a threaded inside, a post having a head which has an outer threaded periphery so as to be engaged with said threaded inside of said tubular body of said connector.

5. The speaker case as claimed in claim 4 further comprising an engaging member which has a threaded shank for being engaged with said threaded inside of said tubular body of said connector, a disk connected to said threaded shank.

6. The speaker case as claimed in claim 1, wherein at least one of said recesses has a serrated periphery, said tubular body of said connector having two flexible bosses on said periphery thereof so as to engage with said serrated periphery of said at least one of said recesses.

7. The speaker case in accordance with claim 1, wherein said speaker case comprises a first part and a second part coupled with each other, said first part has a first surface board having first said four side walls extending therefrom, each of said first said four side walls of said first part has a first said recess defined in an edge thereof, said second part has a second surface board having second said respective opposite four side walls extending therefrom, each of said second said respective opposite four side walls of said second part has a second said recess defined in an edge thereof, and said first recess cooperates with said second recess to define said hole.

8. A speaker case comprising:

four symmetrical side walls each having a recess defined therein, each of said four side walls aligning with a respective opposite side wall, and said recess of each of said four side walls aligning with a recess of said respective opposite side wall to from a hole;

a first part and a second part coupled with each other, said first part including a first surface board having first said four side walls extending therefrom, each of said first said four first side walls of said first said part having a first said recess defined in an edge thereof, said first recess of at least one of said first said four side walls of said first part having a serrated periphery, said second part including a second surface board having second said respective opposite four side walls extending therefrom, each of said second said respective opposite four side walls of said second part having a second recess defined in an edge thereof, said first recess cooperating with said second recess to define said hole; and a connector including a tubular body adapted to be fitted into said hole of one of said four side walls of said speaker case and having two annular grooves each defined in a periphery of said tubular body and each engaged with said side wall of said speaker, said tubular body of said connector having two flexible bosses formed on the periphery thereof so as to engage with said serrated periphery of said first recess of at least one of said four first side walls of said first part.

9. A speaker case comprising:

a first part and a second part coupled with each other so as to have four symmetrical side walls, each of said four side walls aligning with a respective opposite side wall and having a hole defined therein, said hole of each of said four side walls aligning with a hole of said respective opposite side wall, said first part having a first surface board which has first four side walls extending therefrom, each of said first said four side walls of said first part having a first recess defined in an edge thereof, said second part having a second surface board which has second four side walls extending therefrom, each of said second said four side walls of said second part having a second recess defined in an edge thereof, said first,.recess cooperating with said second recess to define said hole, and a connector including a tubular body adapted to be fitted into said hole of one of said four side walls of said speaker case and having two annular grooves each defined in a periphery of said tubular body, and said side wall of said speaker case engaged with one of two annular grooves of said connector.

* * * * *